US008939780B2

(12) United States Patent
Liang et al.

(10) Patent No.: US 8,939,780 B2
(45) Date of Patent: Jan. 27, 2015

(54) CONNECTOR STRUCTURE AND ELECTRONIC DEVICE HAVING THE SAME

(71) Applicant: Wistron Corporation, New Taipei (TW)

(72) Inventors: Chen-Yi Liang, New Taipei (TW); Cheng-Hsiang Chuang, New Taipei (TW); Chun-Chien Chen, New Taipei (TW)

(73) Assignee: Wistron Corporation, Hsichih, New Taipei (TW)

( * ) Notice: Subject to any disclaimer, the term of this patent is extended or adjusted under 35 U.S.C. 154(b) by 1 day.

(21) Appl. No.: 14/017,295

(22) Filed: Sep. 3, 2013

(65) Prior Publication Data

US 2014/0120753 A1 May 1, 2014

(30) Foreign Application Priority Data

Oct. 25, 2012 (TW) ..... 101139474 A

(51) Int. Cl.
*H01R 13/62* (2006.01)
*H01R 13/453* (2006.01)
*H01R 24/62* (2011.01)

(52) U.S. Cl.
CPC ..... *H01R 13/4538* (2013.01); *H01R 24/62* (2013.01); *H01R 2201/06* (2013.01)
USPC ..... 439/157

(58) Field of Classification Search
USPC ..... 439/157, 152, 372, 676
See application file for complete search history.

(56) References Cited

U.S. PATENT DOCUMENTS

| | | | | |
|---|---|---|---|---|
| 5,971,777 | A * | 10/1999 | Garside | 439/131 |
| 6,524,131 | B2 * | 2/2003 | Schmidt et al. | 439/557 |
| 7,713,075 | B2 * | 5/2010 | Choi et al. | 439/152 |
| 7,976,348 | B2 * | 7/2011 | Aekins et al. | 439/676 |
| 2005/0078819 | A1 | 4/2005 | Hsu | |

* cited by examiner

*Primary Examiner* — Edwin A. Leon
(74) *Attorney, Agent, or Firm* — Winston Hsu; Scott Margo

(57) ABSTRACT

In a connector structure, a moving element is pushed by a connector to move horizontally with respect to a first housing, while a linking element is moved accordingly by the moving element vertically with respect to the first housing. With such structural relation, the connector structure may be substantially reduced in its thickness before connection with the connector, saving room for the thickness of an electronic device where the connector structure is disposed. As the connector is inserted to the connector structure, the sinked linking element provides necessary structural support for withholding the connector, securing the contact between the connector and a connecting jack of the connector structure, and preventing the connector from detaching from the connector structure.

20 Claims, 15 Drawing Sheets

CONNECTOR STRUCTURE AND ELECTRONIC DEVICE HAVING THE SAME

BACKGROUND OF THE INVENTION

1. Field of the Invention

The invention relates to a connector structure and an electronic device, and more particularly, to a thinned connector structure disposed on an electronic device for connection with a connector and the electronic device having the same.

2. Description of the Prior Art

Electronic devices with powerful functions have been increasingly popular as the size of the devices is getting smaller. Given the miniaturized trend, these electronic devices still have needs to exchange data with a third-party device or receiving power via signal cables. These signal cables usually have connection with the electronic devices by using a connector, whereas a corresponding connector structure, such as an RJ45 connector structure commonly used for connecting to the Internet, should also be available on the electronic devices. However, the connector structures deployed in the electronic devices should still meet the requirements of the standards, with required dimensions, and this places a fundamental limitation on planning the size and thickness of the housing of an electronic device.

For example, it is common to directly deploy a fixed shaped RJ45 connector structure on the housing of an electronic device, which apparently brings up the limitation as noted. Another possible implementation redesigns the connector structure to have rotating cover on the connector structure that needs to be pulled out and rotated manually by a certain degree before the a corresponding connector can be inserted. This means such connector structure may have even larger size when in use and also needs an extra step of operating the cover before use. Furthermore, such extra cover for blocking the opening of the connector structure is a necessary component but becomes a burden of simple and easy insertion of the connector.

SUMMARY OF THE INVENTION

To improve current design of the connector structure so that the size and dimension of the connector structure may be effectively reduced when not in use, and also to provide easy connection of a connector to the connector structure, the invention provides several embodiments of a thinned connector structure.

In an embodiment of the invention, a connector structure is provided. The connector structure for connecting a connector includes a first housing, a circuit board, a moving element, and a linking element. The first housing includes a plurality of first limiting parts extending along a first direction. The circuit board is mounted on the first housing and includes a connecting jack. The moving element is disposed between the circuit board and the first housing. The moving element includes a pushing part and a first slide. The pushing part is pushed by the connector so that the moving element is moved along a second direction with respect to the first housing and the circuit board. The linking element is disposed between the moving element and the first housing and is moveable along the first direction. The linking element includes a second slide and a plurality of second limiting parts, each of the plurality of second limiting parts corresponding and extending to each of the plurality of first limiting parts along the first direction. The second slide cooperates with the first slide. When the moving element moves along the second direction with respect to the first housing, the first slide is for moving the second slide such that the linking element is moved along the first direction with respect to the first housing and the circuit board and a connecting channel is formed in the connector structure to provide connection between the connector and the connecting jack.

An electronic device is also provided in the embodiment of the invention. The electronic device includes a first housing and a connector structure. The first housing includes a plurality of first limiting parts extending along a first direction. The connector structure for connecting a connector includes a circuit board, a moving element, and a linking element. The circuit board is mounted on the first housing and includes a connecting jack. The moving element is disposed between the circuit board and the first housing. The moving element includes a pushing part and a first slide. The pushing part is pushed by the connector so that the moving element is moved along a second direction with respect to the first housing and the circuit board. The linking element is disposed between the moving element and the first housing and is moveable along the first direction. The linking element includes a second slide and a plurality of second limiting parts, each of the plurality of second limiting parts corresponding and extending to each of the plurality of first limiting parts along the first direction. The second slide cooperates with the first slide. When the moving element moves along the second direction with respect to the first housing, the first slide is for moving the second slide such that the linking element is moved along the first direction with respect to the first housing and the circuit board and a connecting channel is formed in the connector structure to provide connection between the connector and the connecting jack.

In the connector structure and the electronic device provided by the embodiments of the invention, the moving element further includes a third slide and the first housing further includes a fourth slide, each extending along the second direction. The third slide cooperates with the fourth slide such that the moving element is horizontally moveable with respect to the first housing. The third slide is a strip and the fourth slide is a protruding block.

In the connector structure and the electronic device provided by the embodiments of the invention, the connector structure further includes a restoring element disposed between the moving element and the first housing to be moved by the moving element to have a restoring force when the moving element moves along the second direction with respect to the first housing. The moving element further includes a guiding rod extending along the second direction and the restoring element is disposed on the guiding rod and abutting against the first housing. The restoring element may be a compression spring, a stretch spring, or a pair of homopolar magnets.

In the connector structure and the electronic device provided by the embodiments of the invention, a second housing is further provided to be assembled with the first housing. The second housing includes an opening, and the connector pushes the pushing part of the moving element through the opening.

In the connector structure and the electronic device provided by the embodiments of the invention, the first slide of the moving element is a slideway including a horizontal section and a slanting section. The horizontal section extends along the second direction, the slanting section is connected to the horizontal section and extends along a third direction, and the second slide is a sliding block slidable in the slideway. When the moving element moves along the second direction with respect to the first housing, the second slide is to move in the horizontal section such that the moving element moves along the second direction with respect to the linking element, whereas the second slide is to be moved by the slated section such that the linking element moves along the first direction with respect to the first housing.

In the connector structure and the electronic device provided by the embodiments of the invention, the first direction and the second direction are perpendicular to each other.

In the connector structure and the electronic device provided by the embodiments of the invention, the third slide is disposed at a central opening of the moving element and the first slide comprises a plurality of slide units disposed at two opposite sides of the moving element.

In the connector structure and the electronic device provided by the embodiments of the invention, the first limiting parts are axle holes and the second limiting parts are limiting posts moving in the axle holes along the first direction.

In the connector structure and the electronic device provided by the embodiments of the invention, the linking element further includes a supporting part and a blocking part. The moving element includes a slot corresponding to the position of the supporting part. The connector includes a relieve bar, and the supporting part extends along the first direction through the slot and to abut against the connector. The blocking part is to abut against the relieve bar and restrain the connector from detaching off the connector structure when the connector is in connection with the connecting jack.

The connector structure and the electronic device provided by the embodiments of the invention provide an apparent reduced thickness before connected to a connector, saving room needed in the electronic device. Without compromising satisfying the regulation of the dimension required by implementing the connector structure, the connector may still be well contained by the connector structure when the connector is connected to the connector structure.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 9 is an illustration showing a structural view about the connector structure with the connector yet to be plugged in.

FIG. 10 is an illustration showing a structural view about the connector structure with the connector plugged in.

FIG. 11 is an illustration showing a side cross-sectional view about the connector structure with the connector yet to be plugged in.

FIG. 12 is an illustration showing a side cross-sectional view about the connector structure with the connector plugged in.

DETAILED DESCRIPTION

Certain terms are used throughout the following description and claims to refer to particular system components. As one skilled in the art will appreciate, manufacturers may refer to a component by different names. In the following discussion and in the claims, the terms "include" and "comprise" are used in an open-ended fashion. Also, the term "couple" is intended to mean either an indirect or direct electrical connection. Thus, if a first device is coupled to a second device, that connection may be through a direct electrical connection, or through an indirect electrical connection via other devices and connections.

Figure 1:
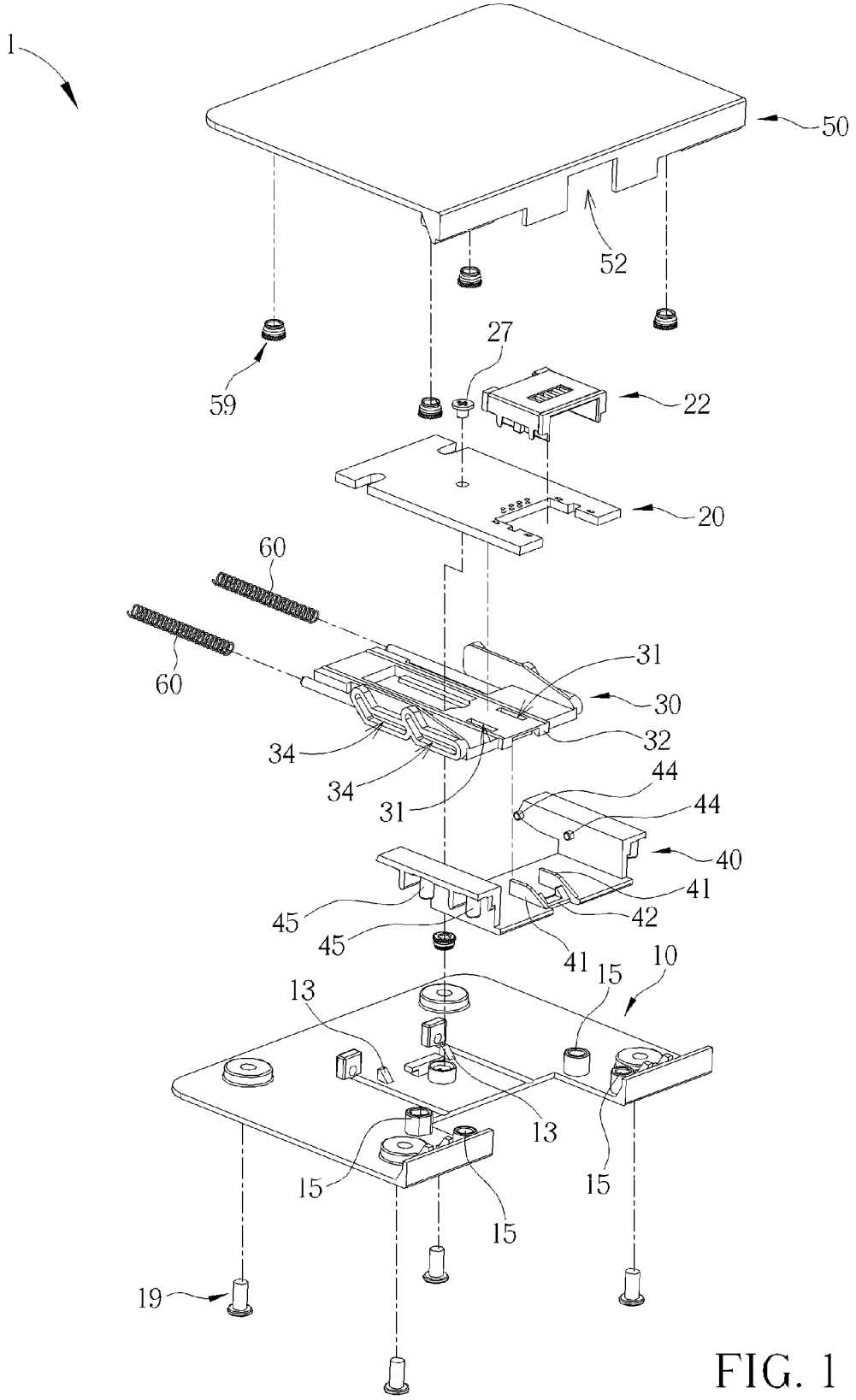
FIG. 1 is an illustration showing an exploded view of every components of a connector structure according to an embodiment of the invention.
Figure 7:
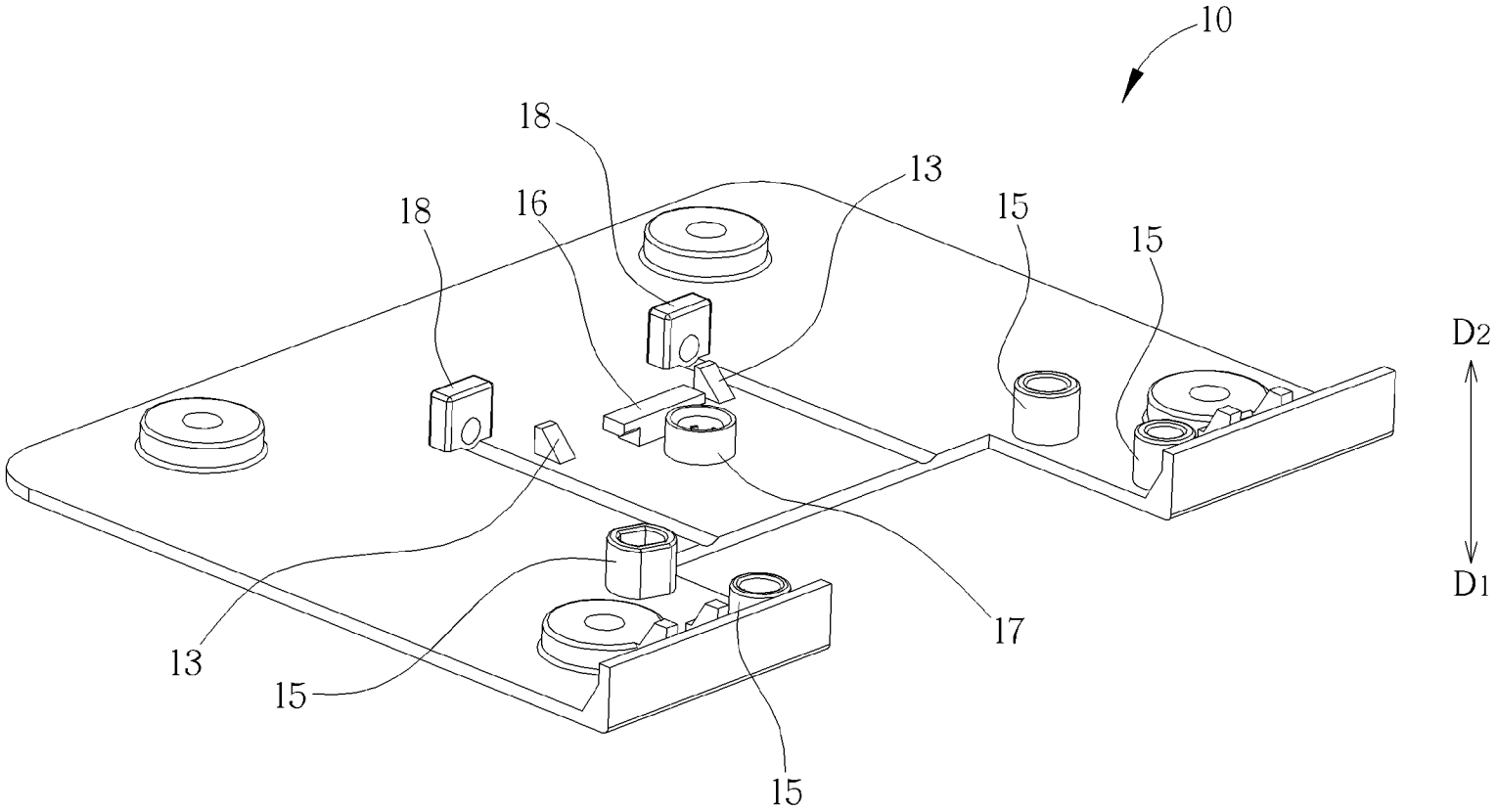
FIG. 7 is an illustration of the first housing of the connector structure.

Please refer to FIG. 1. FIG. 1 is an illustration showing an exploded view of every components of a connector structure according to an embodiment of the invention. The connector structure 1 includes a first housing 10 (the bottom housing), a second housing 50 (the top housing), a circuit board 20, a moving element 30, and a linking element 40. The first housing 10 and the second housing 50 may be just part of the housing of an electronic device where the connector structure 1 is disposed, while in other embodiments, the first housing 10 and the second housing 50 may also be manufactured as a module in advance and then be assembled to the housing of the electronic device. The circuit board 20 is mounted on the first housing 10 by using screws 27 to fix the circuit board 20 to the screw posts 17 as shown in FIG. 7. The circuit board 20 includes a connecting jack 22 adapted for coupling with a connector, such as the connector 100 shown in FIG. 2, so that an electrical connection may be established between the connecting jack 22 and the connector 100 and a device which the connector 100 is connected may be electrically connected to the electronic device. The connecting jack 22 of the connector structure 1 is illustrated and exemplified as an RJ45 Internet connector. However, the invention places no restriction on the type of connector/connecting jack that can be implemented with the structure disclosed in the invention. Any connector/connecting jack/connector structure of any type is suitable for implementation of the structure of the invention to have reduced thickness before use and not compromising satisfying the regulation of the dimension required by implementing the connector structure to well contain the corresponding connector when the connector is connected to the connector structure.

Figure 8:
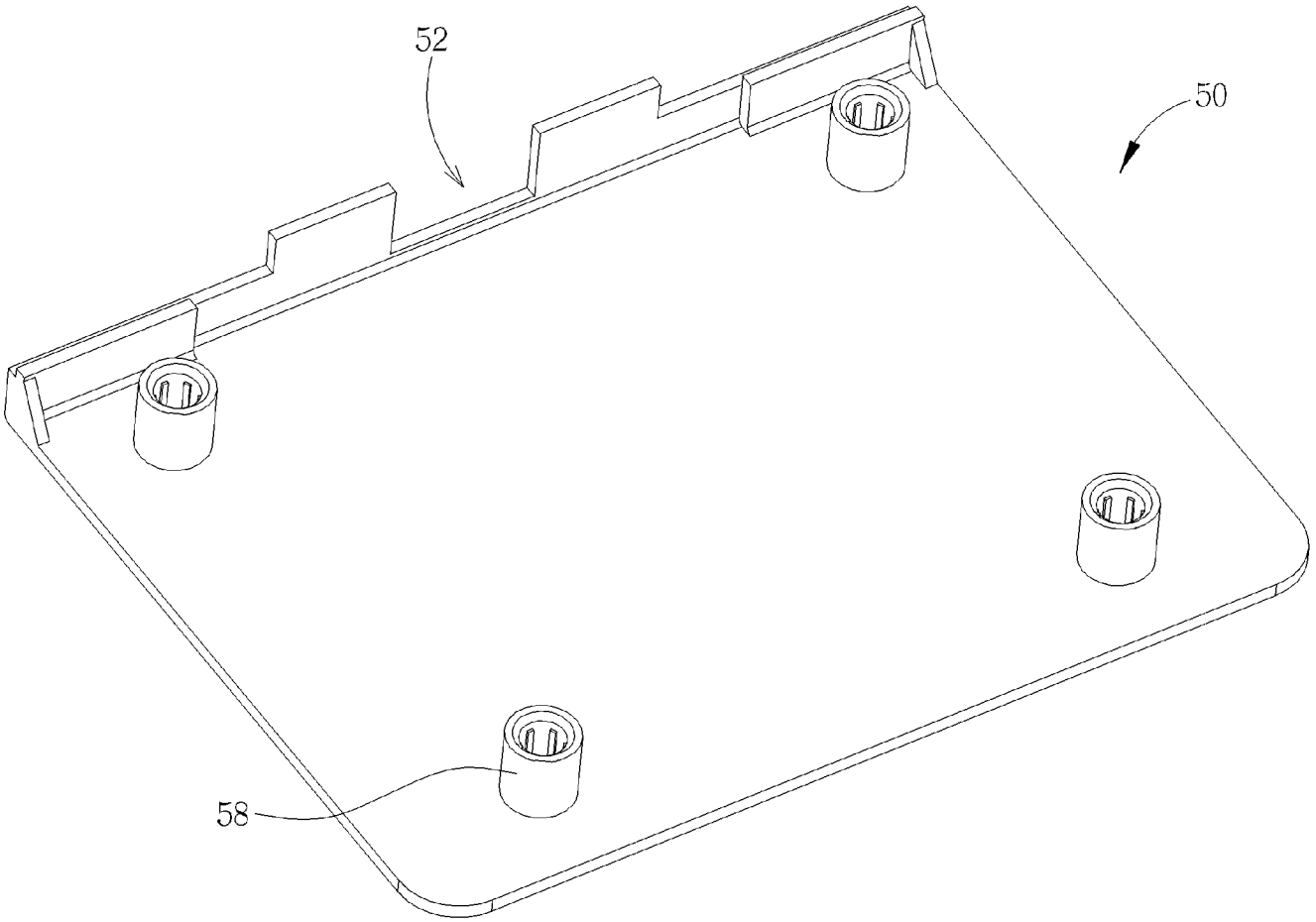
FIG. 8 is an illustration of a second housing of the connector structure.

The first housing 10 and the second housing 50 are assembled together via screws 19, assembling parts 58 as showing in the second housing 50 in FIG. 8, and nuts 59 assembling with one another. The moving element 30 and the linking element 40 are moveably disposed between the circuit board 20 and the first housing 10, in which the moving element 30 is disposed between the circuit board 20 and the first housing 10 adapted to be pushed by the connector 100 to have horizontal movement with respect to the first housing 10. The connector 100 pushes the moving element 30 through an opening 52 of the second housing 50, referring to FIG. 8 for the opening 52, whereas the linking element 40 is disposed between the moving element 30 and the first housing 10 and is adapted to be pushed and moved by the moving element 30 to have vertical movement with respect to the first housing 10. The structural linking relation of these components is described in detail in the following paragraphs and illustrations.

Figure 2:
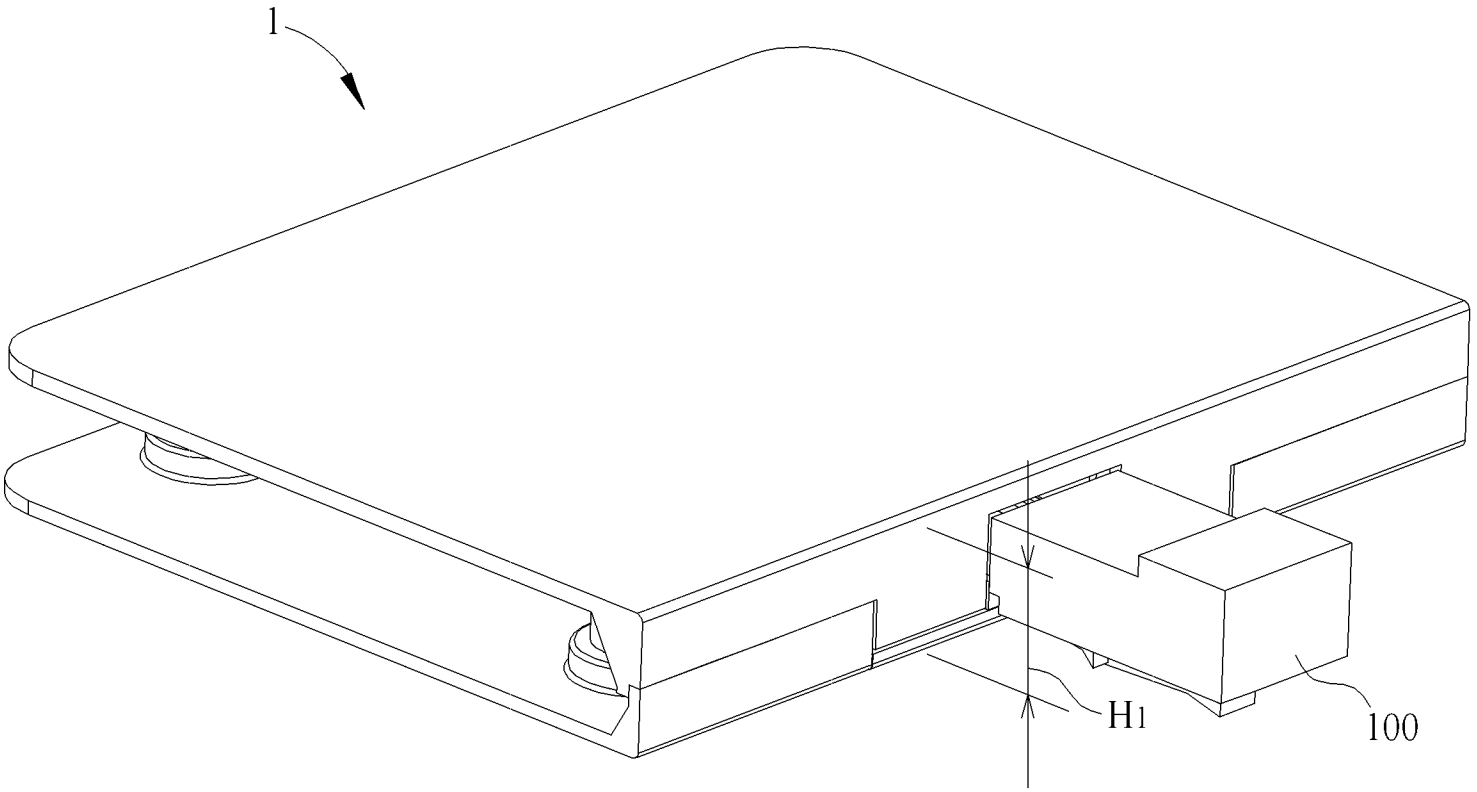
FIG. 2 is an illustration of the connector structure and a connector according to a first embodiment of the invention.
Figure 3:
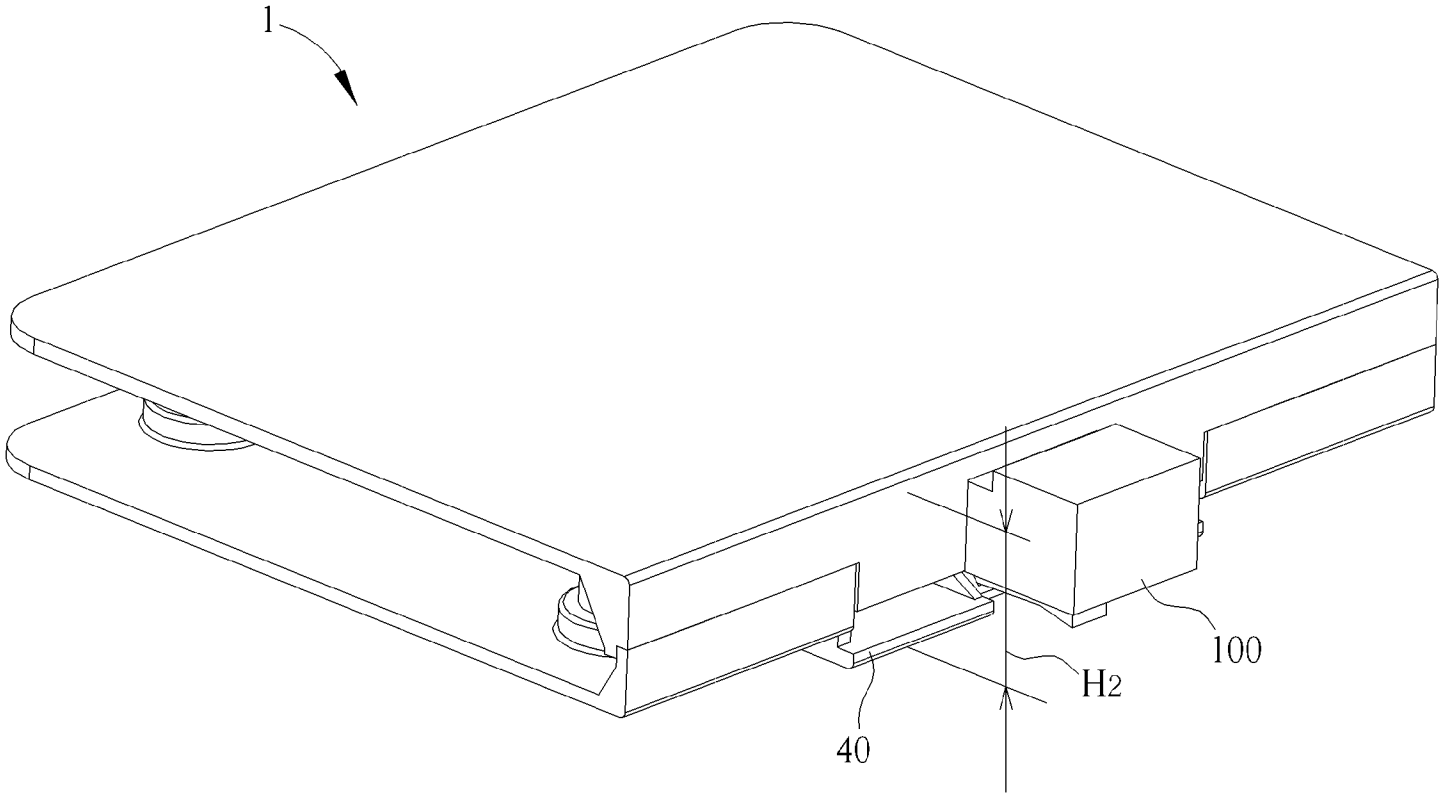
FIG. 3 is an illustration showing the connector plugging to have connection with the connector structure.

Please refer to FIG. 2 and FIG. 3. FIG. 2 is an illustration of the connector structure and a connector according to a first embodiment of the invention and FIG. 3 is an illustration showing the connector plugging to have connection with the connector structure. As illustrated in FIG. 2, the maximum thickness $H_1$ of the connector structure 1, before the connector 100 is plugged into the connector structure 1, is smaller than regulated for the connector 100. This provides more flexibility when designing the dimension of an electronic device using the connector structure 1. As shown in FIG. 3, when the connector 100 is plugged into the connector structure 1, the linking element 40 of the connector structure 1 will be brought to move downward such that the thickness of the connector structure 1 is increased to $H_2$, thereby providing necessary dimension for the connector 100. The space beneath for the linking element 40 to move downward may be provided from the lift by cushions disposed below the electronic device.

Figure 4:
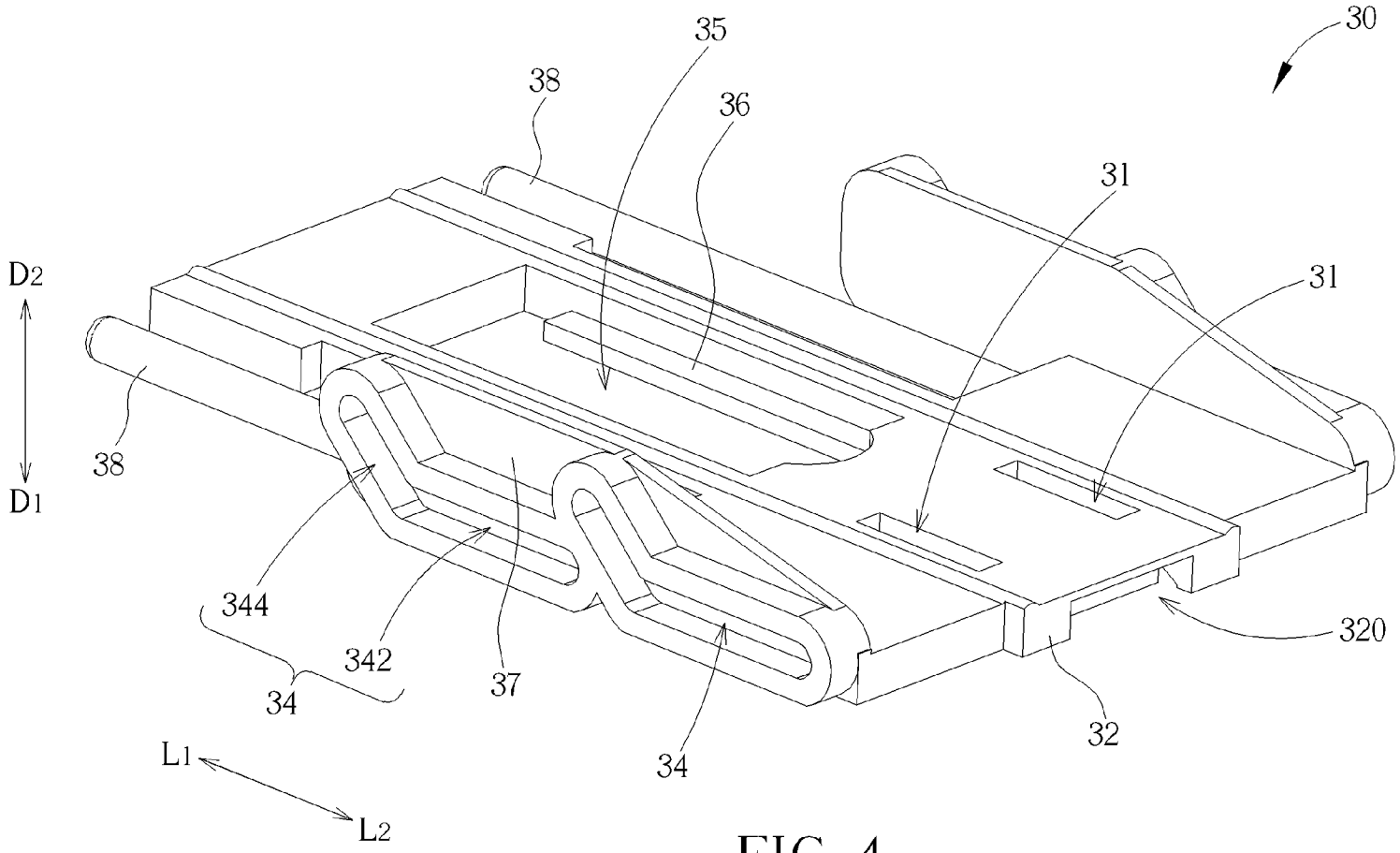
FIG. 4 is an illustration showing a top perspective view of the moving element of the connector structure.
Figure 5:
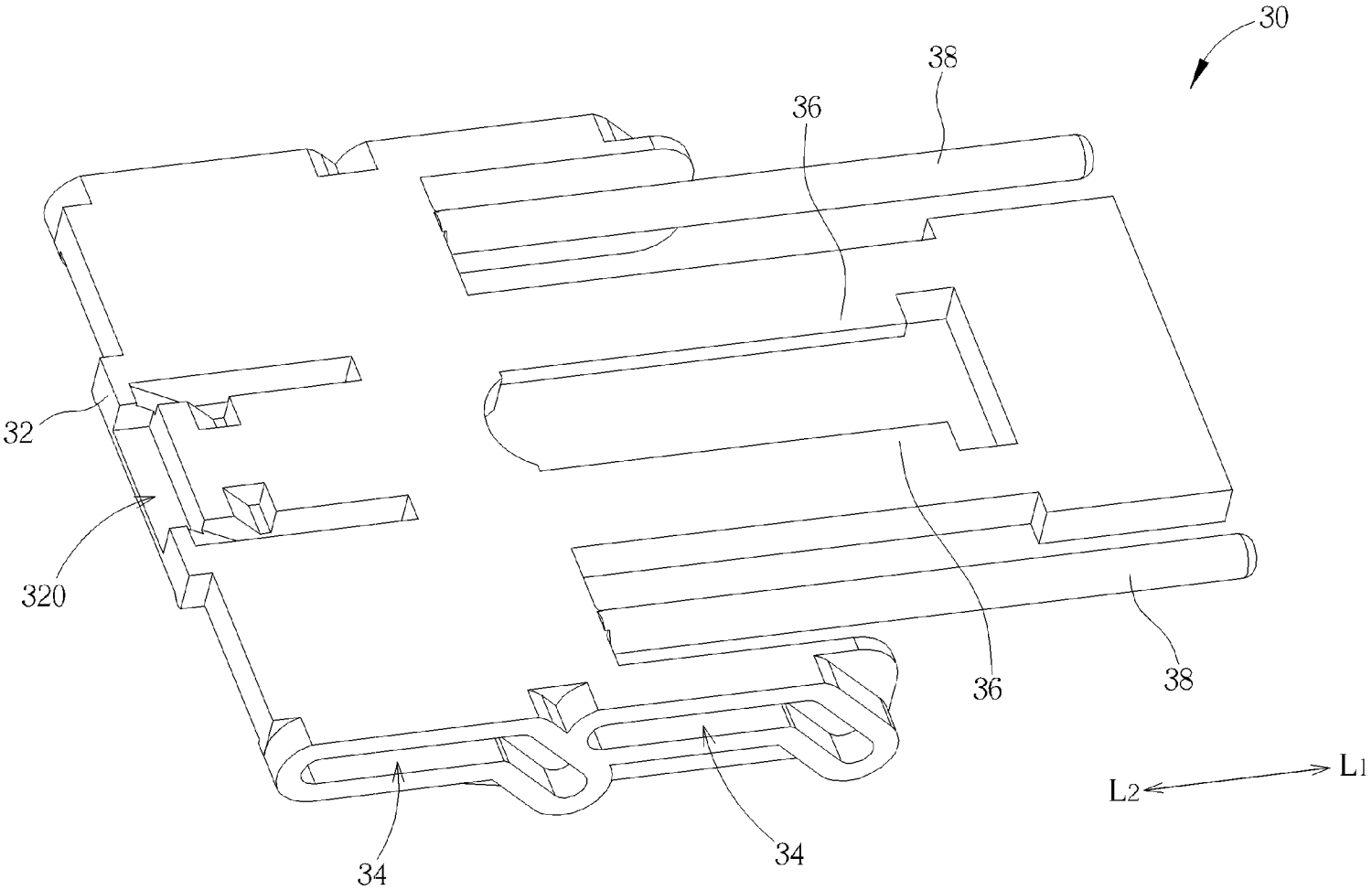
FIG. 5 is an illustration showing a bottom perspective view of the moving element of the connector structure.
Figure 6:
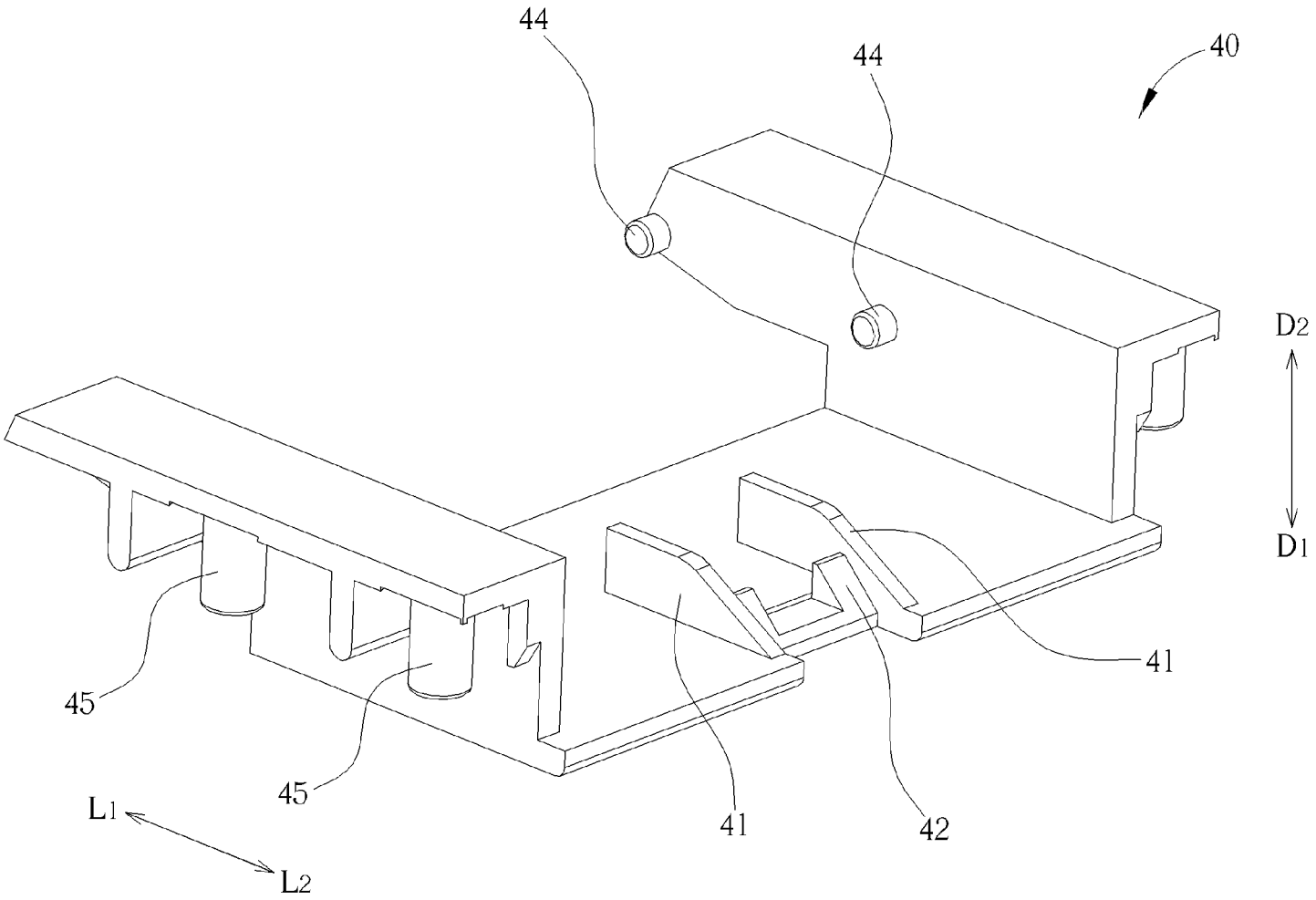
FIG. 6 is an illustration of the linking element of the connector structure.

Please refer to FIG. 4 to FIG. 7. FIG. 4 and FIG. 5 are illustrations showing a top perspective view and a bottom perspective view of the moving element 30 of the connector structure 1 respectively, FIG. 6 is an illustration of the linking element 40 of the connector structure 1, and FIG. 7 is an illustration of the first housing 10 of the connector structure 1. As described in previous paragraphs, the moving element 30 is disposed between the circuit board 20 and the first housing 10 and the linking element 40 is disposed between the moving element 30 and the first housing 10. The moving element 30 includes a pushing part 32 and a first slide 34. The pushing part 32 is located at a front portion of the connector structure 1 and is adapted for being pushed by the connector 100. Meanwhile, the moving element 30 may also be adapted to have complete coverage over the opening of the connector structure 1. For better positioning sense of the connector 100 to have push against the moving element 30, a concaved part 320 may also be disposed on the pushing part 32 that resembles the shape of the connector 100 to facilitate push of the connector 100 toward the moving element 30.

The first slide 34 of the moving element 30 has cooperative relation with a second slide 44 of the linking element 40. In this embodiment, the first slide 34 of the moving element 30 has implementation as a slideway having a plurality of slide units disposed at two opposite sides of the moving element 30. The first slide 34 has a horizontal section 342 and a slanting section 344. The horizontal section 342 extends along a horizontal direction $L_1L_2$ and the slanting section 344 is connected to the horizontal section 342 and extends along a slanting direction, which means the slanting section 344 extends both along the horizontal direction $L_1L_2$ and a vertical direction $D_1D_2$. However, the first slide 34 may also have other contour other than what is illustrated and described in the embodiment shown in FIG. 4, i.e., the combination of the horizontal section 342 and the slanting section 344. The first slide 34 may preferably have contour in correspondence with actual mechanism of the moving element 30 and the linking element 40 that may carry out what is needed to accomplish the invention. The second slide 44 of the linking element 40 has implementation as a sliding block extending in the first slide 34, the slideway, and is slidable in the slideway. In the first embodiment, a smooth cooperation between the moving element 30 and the linking element 40 may be achieved by each of the first slide 34 and the second slide 44 is disposed in a pair at both sides of the moving element 30 and the linking element 40, in cooperation with each other. However, the first slide 34 and the second slide 44 may also be implemented as a slideway and a sliding block cooperative with each other as one side of the moving element 30 and the linking element 40.

To more stabilize the moving element 30 with smooth horizontal movement on the first housing 10, the moving element 30 may also have a third slide 36 disposed at a central opening 35 of the moving element 30 and the first housing 10 may further have a fourth slide 16 adapted to cooperate with the third slide 36. In the embodiment, the third slide 36 may be implemented as a slot with strip at both sides and extending along direction $L_1L_2$, whereas the fourth slide 16 is implemented as a protruding block adapted for pressing against the strip downward. In such implementation, as the moving element 30 is pushed to move along direction $L_1L_2$ with respect to the first housing 10, the cooperation of the third slide 36 and the fourth slide 16 ensures the smooth movement of the moving element 30 in the horizontal direction.

Figure 9:
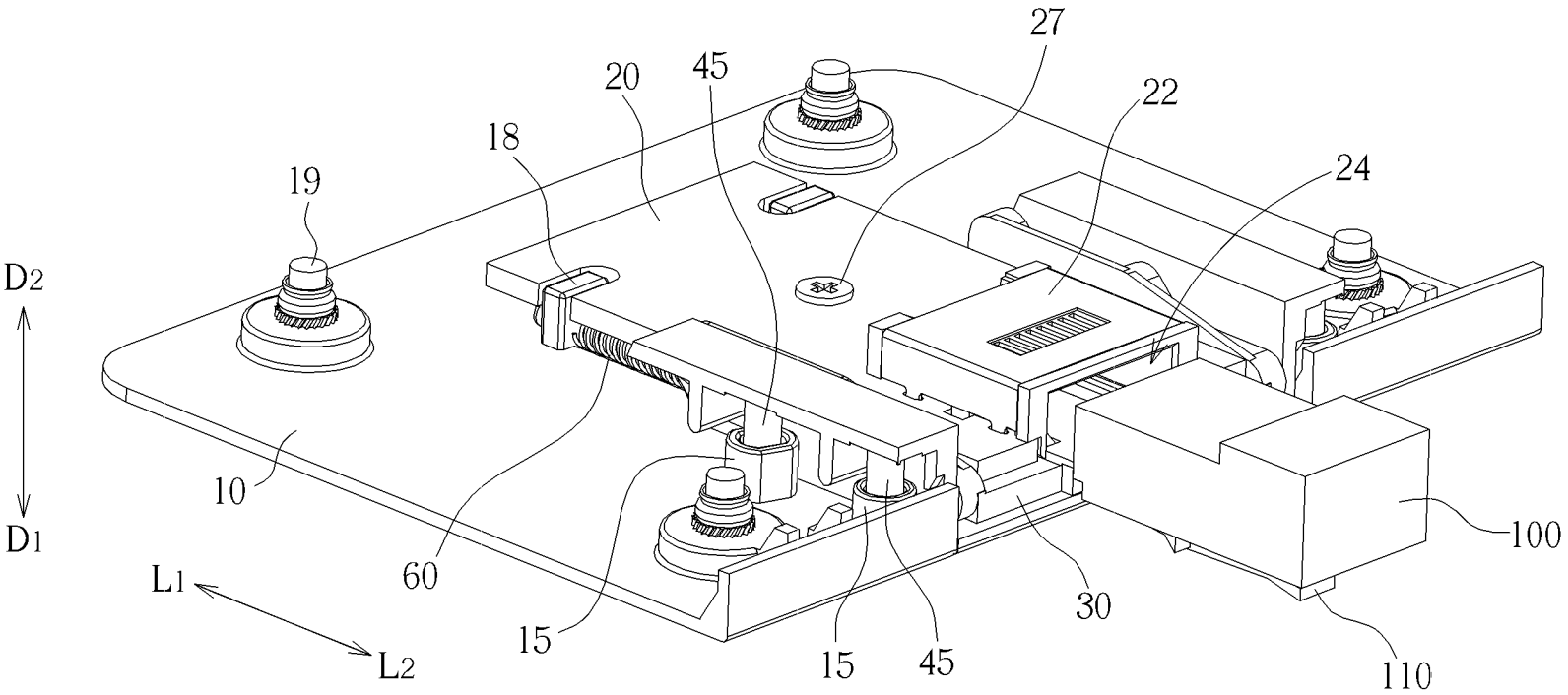
Figure 10:
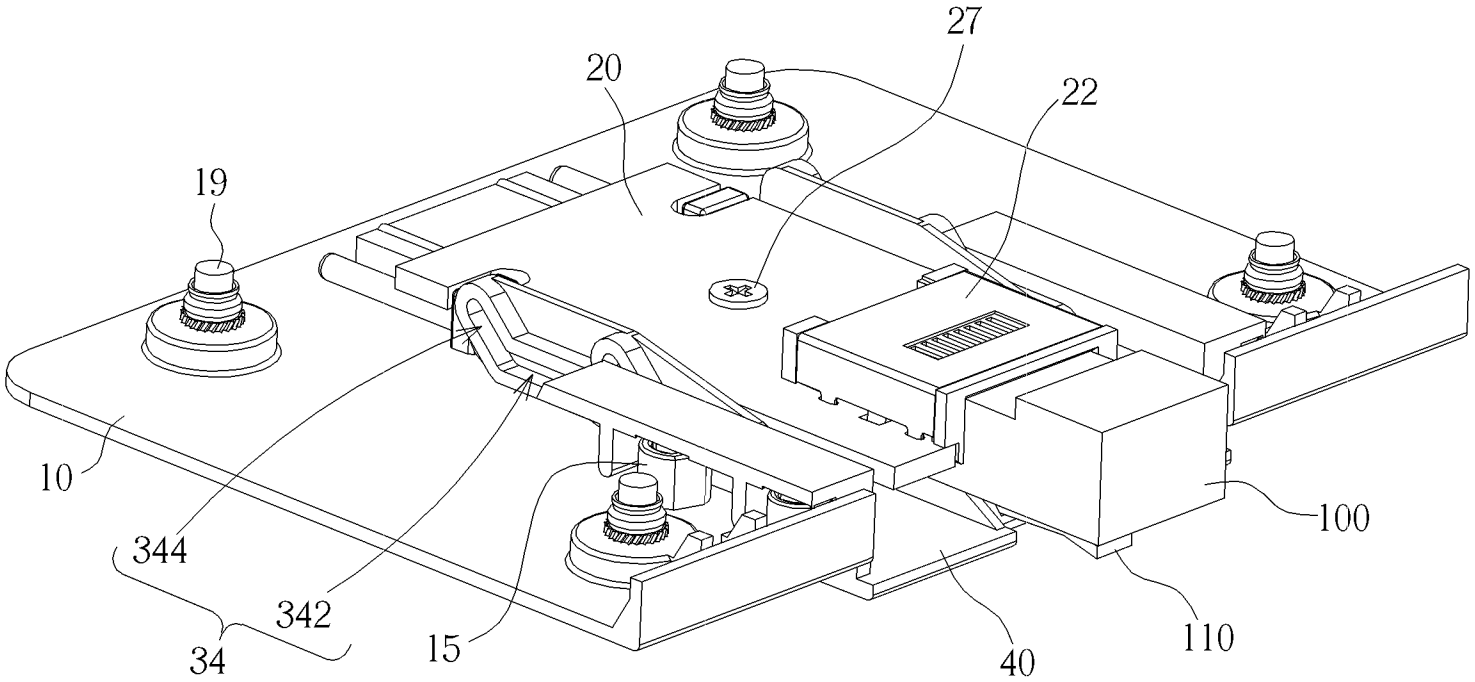
Figure 11:
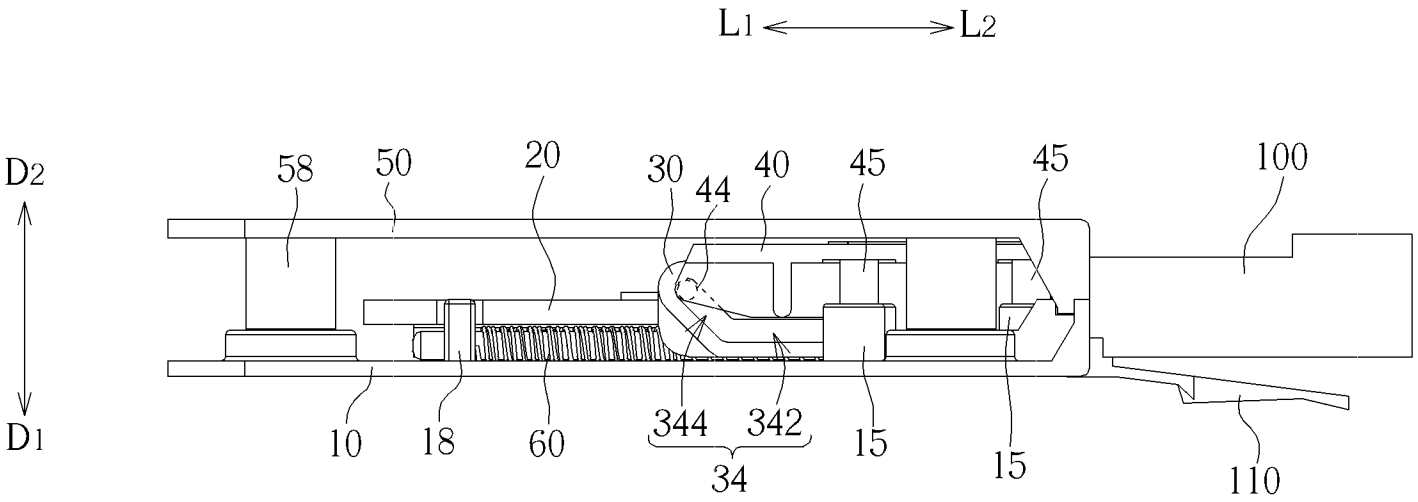
Figure 12:
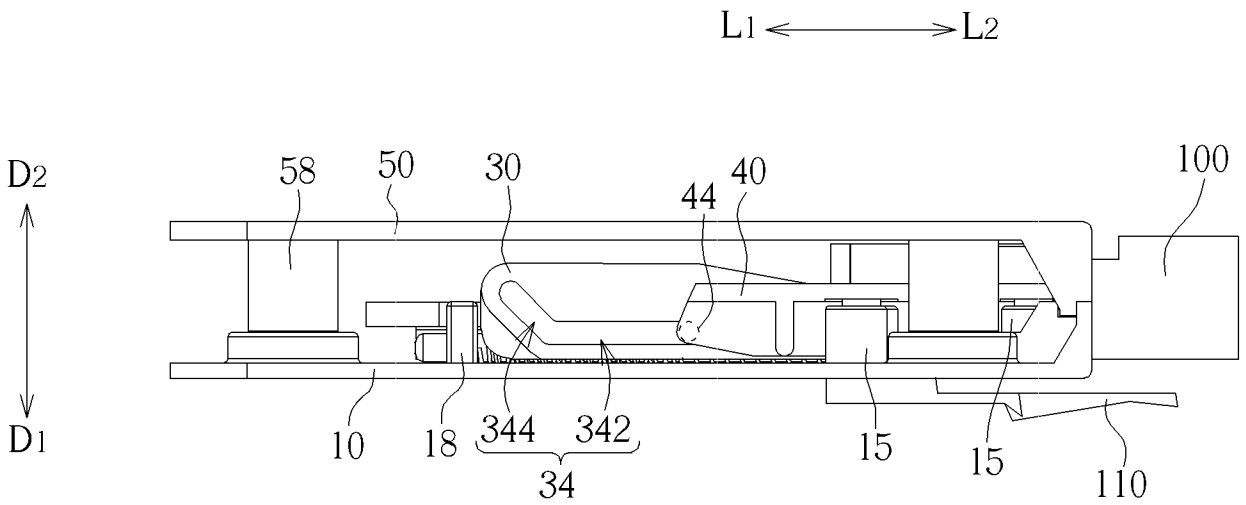

Please refer to FIG. 9 to FIG. 12. FIG. 9 and FIG. 11 are illustrations showing a structural view and a side cross-sectional view respectively about the connector structure 1 with the connector 100 yet to be plugged in, and FIG. 10 and FIG. 11 are illustrations showing a structural view and a side cross-sectional view respectively about the connector structure 1 with the connector 100 plugged in. Due to the orientations of the horizontal section 342 and the slanting section 344 of the first slide 34, as the connector structure 1 is at the state as shown in FIG. 9 and FIG. 11, in which the connector 100 is yet to be plugged in, the second slide 44 of the linking element 40 is at the position of the end of the slanting section 344 of the first slide 34 of the moving element 30. Once the connector 100 pushes the moving element 30 along direction $L_1$, the horizontal direction, the moving element 30 moves along the horizontal direction with respect to the first housing 10, whereas the first slide 34 of the moving element 30 is adapted to move with respect to the second slide 44, wherein the slanting section 344 moves the second slide 44 along direction $D_1$ downward. In such way, the linking element 40 is moved by the moving element 30 downward (along direction $D_1$) with respect to the first housing 10, all the way until the connector structure 1 reaches the state as shown in FIG. 10 and FIG. 12 where the second slide 44 is located at an end of the horizontal section 342.

That is, the cooperation of the first slide 34 of the moving element 30 and the second slide 44 of the linking element 40 makes it happen that when the moving element 30 is pushed to move horizontally with respect to the first housing 10, the linking element 40 is also moved to have movement vertically with respect to the first housing 10. As the linking element 40 moves vertically with respect to the first housing 10, a connecting channel is formed between the linking element 40 and the connecting jack 22 as shown in FIG. 9 to provide connection between the connector 100 and the connecting jack 22.

Please keep referring to FIG. 4, FIG. 6, and FIG. 7. The linking element 40 further includes a plurality of second limiting parts 45, while the first housing 10 includes a plurality of first limiting parts 15, each corresponding to one of the second limiting parts 45. In the embodiment, the first limiting parts 15 are exemplified as axle holes and the second limiting parts 45 are exemplified as limiting posts extending corresponding axle holes. Also in the embodiment, the first limiting parts 15 extend vertically along direction $D_1D_2$ and each of the second limiting parts 45 corresponds and extends to each of the first limiting parts 15 along direction $D_1D_2$. Hence, as the moving element 30 moves the linking element 40 as described previously, the cooperation of the first limiting parts 15 and the second limiting parts 45 ensures the linking element 40 to have movement vertically with respect to the first housing 10. Since the primary purpose of the first limiting parts 15 cooperating with the second limiting parts 45 is to make sure the linking element 40 to move along direction $D_1D_2$, the first limiting parts 15 and the second limiting parts 45 may have other possible implementation than what is disclosed and described in the figures. For example, the first limiting parts 15 may also be limiting posts and the second limiting parts 45 are corresponding axle holes, or they may have the form of slideway and slot. Additionally, when the linking element 40 moves downward (along direction $D_1$) with respect to the first housing 10 and the connecting channel 24 is formed therein for allowing the connector 100 to plug in and have connection with the connecting jack 22, the linking element 40 may further use a supporting part 41, which is exemplified as a protrusion extending upward along direction $D_2$ through a slot 31 of the moving element 30 where the slot 31 is a long slit having orientation along direction $L_1L_2$, to abut against the connector 100 and keep the connector 100 at a right position in the connecting channel 24. The linking element 40 further has a blocking part 42 located between the supporting part 41 and adapted to abut against a relieve bar 110 of the connector 100 and to restrain the connector 100 from detaching off the connector structure 1. In the embodiment, the blocking part 42 is configured, but not limited to, to be placed between the supporting part 41 to correspond to the position of the relieve bar 110 of the connector 100, the relieve bar of an RJ45 connector for example.

Additionally, the connector structure 1 of the invention also utilizes a restoring element to go back to a state as shown in FIG. 9 and FIG. 11 as the relieve bar 110 of the connector 100 is no longer abutted by the blocking part 42 and the connector 100 is detached from the connector structure 1. Please refer to FIG. 1, FIG. 4, and FIG. 7. The connector structure 1 further includes a restoring element 60, which is exemplified as a compression spring in the embodiment but may also be a stretch spring or a pair of homopolar magnets in other embodiments, disposed between the moving element 30 and the first housing 10. Preferably, the moving element 30 has a guiding rod 38 extending horizontally along direction $L_1L_2$. The restoring element 60 in the form of a compression spring is disposed on the guiding rod 38 and abuts against a hole seat 18 of the first housing 10 where the opening on the hole seat 18 provides room for the movement of the guiding rod 38. It should be noted that using the guiding rod 38 is not the only way to dispose the restoring element 60.

When the moving element 30 is pushed by the connector 100 to have horizontal movement along direction $L_1L_2$ with respect of the first housing 10, the restoring element 60 is moved and compressed by the moving element 30 and have a restoring force. As for the cases that the restoring element 60 is implemented as a stretch spring or a pair of homopolar magnets, structural relations among the restoring element 60, the moving element 30 and the first housing 10 may be alternated to properly function as needed. Once the connector 100 is removed from the connector structure 1, the restoring element 60 is released from being compressed by the moving element 30 and pushes the moving element 30 to move horizontally along direction $L_2$ with respect to the first housing 10, all the way until a limiting side 33 of the moving element 30 is abutted by a pushing part 13 of the first housing 10, preventing from the moving element 30 being overly pushed outward by the restoring element 60. Meanwhile, the first slide 34 of the moving element 30 guides the second slide 44 and moves the linking element 40 upward along direction $D_2$ with respect to the first housing 10 to the position before the linking element 40 sinks.

Figure 13:
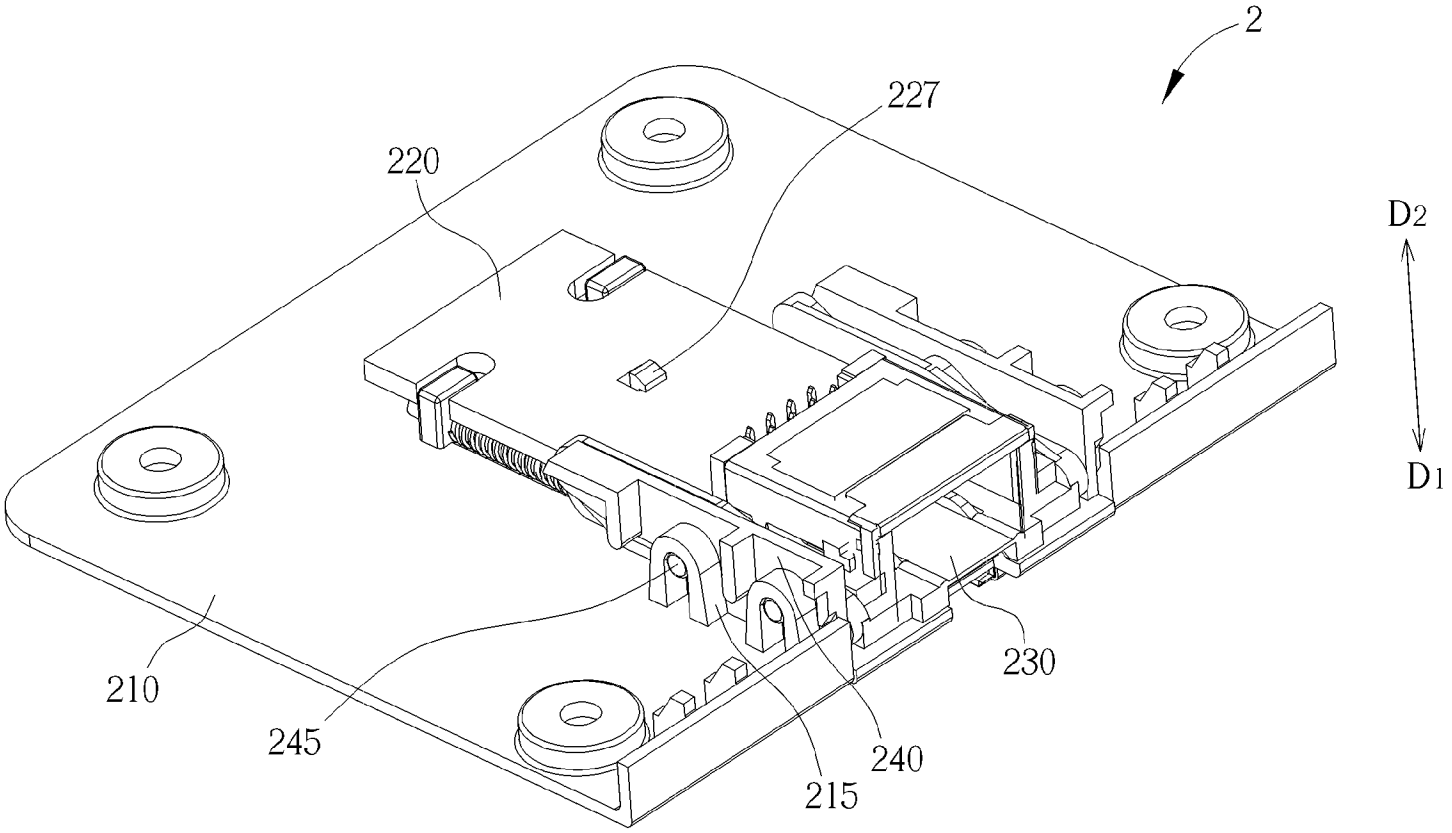
FIG. 13 is an illustration of a connector structure according to a second embodiment of the invention.
Figure 14:
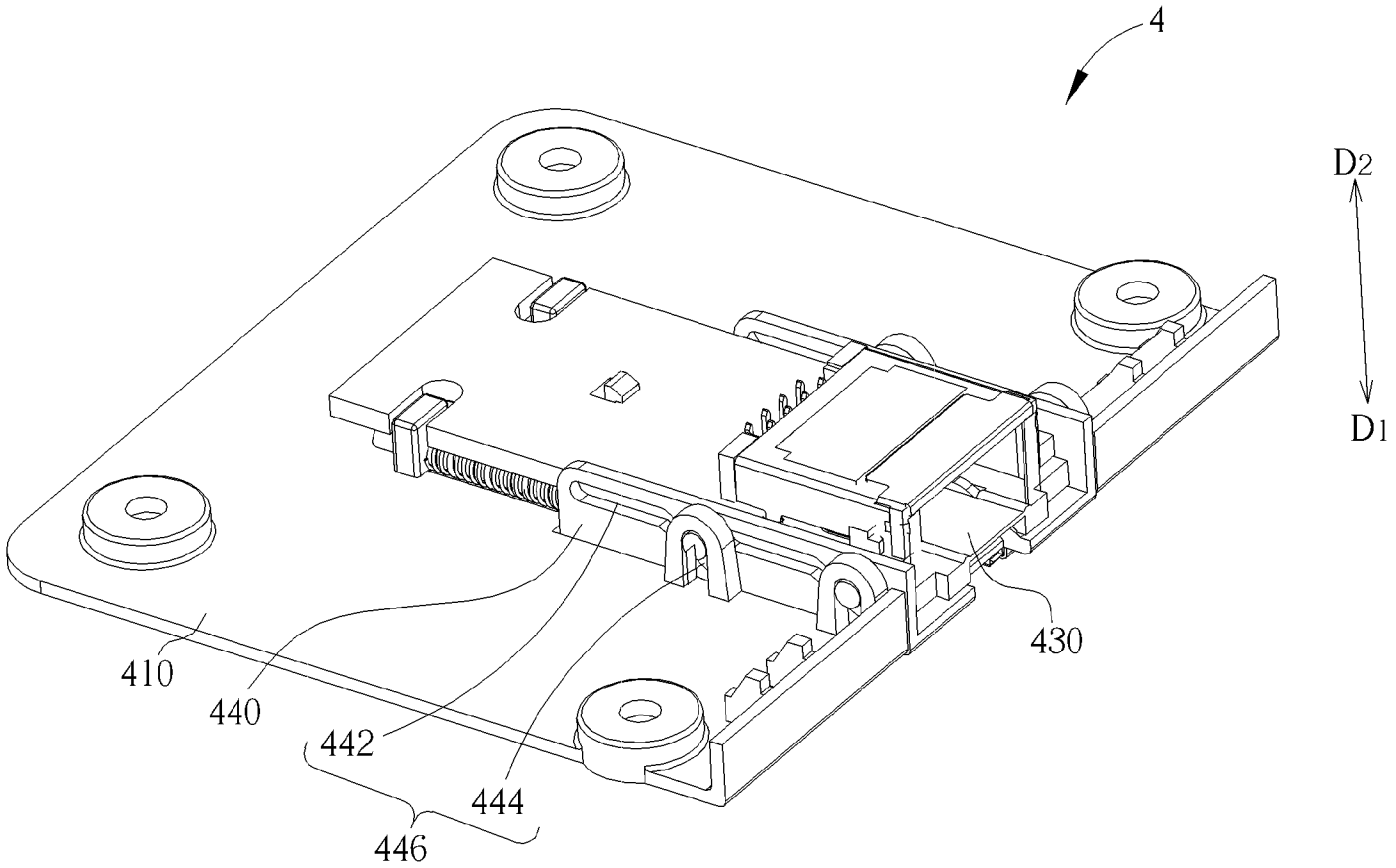
FIG. 14 is an illustration of a connector structure according to a third embodiment of the invention.

Please refer to FIG. 13 and FIG. 14. FIG. 13 is an illustration of a connector structure according to a second embodiment of the invention and FIG. 14 is an illustration of a connector structure according to a third embodiment of the invention. For the embodiment shown in FIG. 13, the structural relations among components of a connector structure 2 are substantially similar as those of the connector structure 1, while in the second embodiment, the circuit board 220 is assembled to the first housing 210 via a hook 227 and the second limiting parts 245 of the linking element 240 are posts extending horizontally to the first limiting parts 215 of the first housing 210 where the first limiting parts 215 are slots with vertical orientation along direction $D_1D_2$. As the linking element 240 is moved by the moving element 230, the second limiting parts 245 moves in the first limiting parts 215 to ensure the linking element 240 having vertical movement with respect to the first housing 210.

For the embodiment in FIG. 14, the structural relations among components of a connector structure 4 are substantially similar as those of the connector structure 1 and the connector structure 2, while the connector structure 4 has alternated configuration of first slide and second slide from the moving element 430 and the linking element 440. The second slide 446 of the linking element 440 is a slideway having a horizontal section 442 and a slanting section 444 and the first slide of the moving element 430, which is not shown in the figure, may be a sliding block extending to the second slide 446. Related operational mechanism is similar as what is disclosed in the connector structure 1 and detained description is omitted here for brevity.

Figure 15:
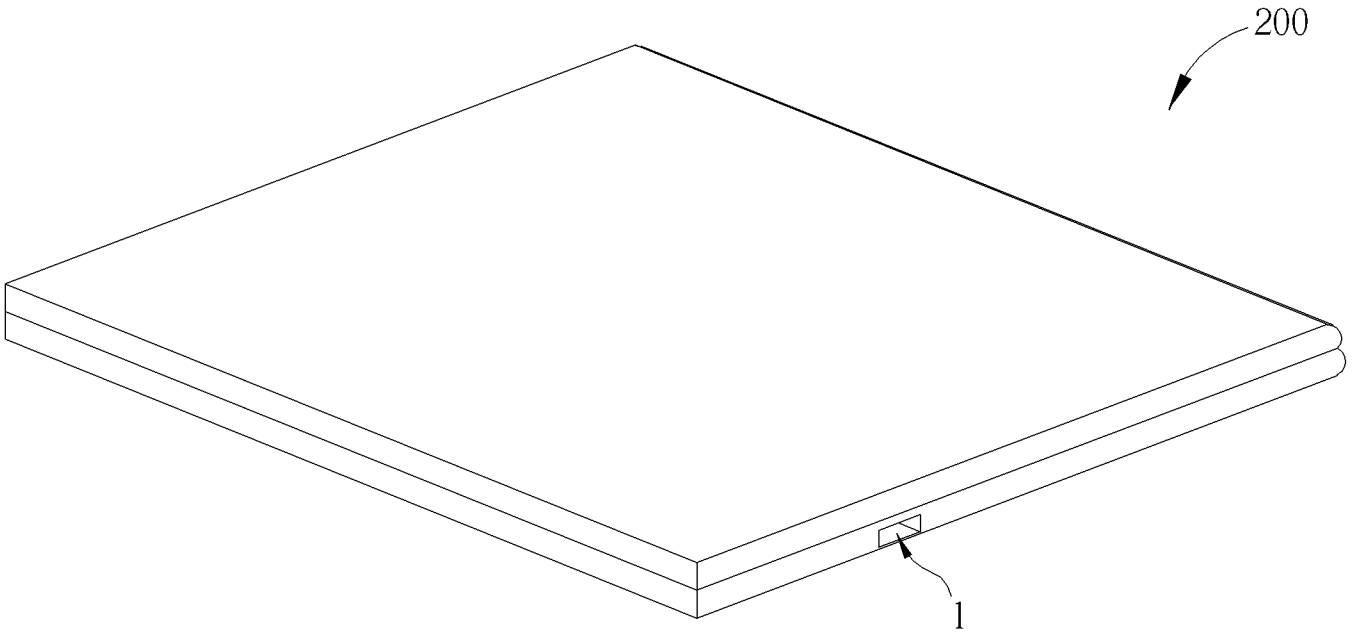
FIG. 15 is an illustration of an electronic device according to an embodiment of the invention.

Please refer to FIG. 15. FIG. 15 is an illustration of an electronic device according to an embodiment of the invention. The electronic device 200 has the connector structure 1, or the connector structure 2 or the connector structure 4, implemented therein. As previously noted, the first housing 10 and the second housing 50 of the connector structure 1 may be just part of the housing of the electronic device 100, while in other embodiments, the first housing 10 and the second housing 50 may also be manufactured as a module in advance and then be assembled to the housing of the electronic device 100. Additionally, the electronic device 200 may be portable devices such as a laptop computer, an ultrabook, or the like.

The embodiments of the invention provides the connector structure that has the moving element adapted to be pushed by the connector to move horizontally with respect to the first housing, while the linking element is moved accordingly by the moving element vertically with respect to the first housing. With such structural relation, the connector structure may be substantially reduced in its thickness before connection with the connector, saving room for the thickness of the electronic device where the connector structure is disposed. As the connector is inserted to the connector structure, the sinked linking element provides necessary structural support for withholding the connector, securing the contact between the connector and the connecting jack of the connector structure, and preventing the connector from detaching from the connector structure.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A connector structure for connecting a connector, the connector structure comprising:

a first housing comprising a plurality of first limiting parts extending along a first direction;

a circuit board mounted on the first housing and comprising a connecting jack;

a moving element disposed between the circuit board and the first housing, the moving element comprising a pushing part and a first slide, the pushing part pushed by the connector so that the moving element is moved along a second direction with respect to the first housing and the circuit board; and a linking element disposed between the moving element and the first housing and moveable along the first direction, the linking element comprising a second slide and a plurality of second limiting parts, each of the plurality of second limiting parts corresponding and extending to each of the plurality of first limiting parts along the first direction, the second slide cooperating with the first slide;

wherein when the moving element moves along the second direction with respect to the first housing, the first slide is for moving the second slide such that the linking element is moved along the first direction with respect to the first housing and the circuit board and a connecting channel is formed to provide connection between the connector and the connecting jack.

2. The connector structure of claim 1, wherein the moving element further comprises a third slide and the first housing further comprising a fourth slide, each extending along the second direction, the third slide cooperating with the fourth slide such that the moving element is horizontally moveable with respect to the first housing.

3. The connector structure of claim 2, wherein the third slide is a strip and the fourth slide is a protruding block.

4. The connector structure of claim 2, wherein the third slide is disposed at a central opening of the moving element and the first slide comprises a plurality of slide units disposed at two opposite sides of the moving element.

5. The connector structure of claim 1, further comprising a restoring element disposed between the moving element and the first housing and to be moved by the moving element to have a restoring force when the moving element moves along the second direction with respect to the first housing.

6. The connector structure of claim 5, wherein the moving element further comprises a guiding rod extending along the second direction and the restoring element is disposed on the guiding rod and abutting against the first housing.

7. The connector structure of claim 5, wherein the restoring element is a compression spring, a stretch spring, or a pair of homopolar magnets.

8. The connector structure of claim 1, further comprising a second housing assembled with the first housing, the second housing comprising an opening, the connector pushing the pushing part of the moving element through the opening.

9. The connector structure of claim 1, wherein the first slide of the moving element is a slideway comprising a horizontal section and a slanting section, the horizontal section extending along the second direction, the slanting section connected to the horizontal section and extending along a third direction, and the second slide is a sliding block slidable in the slideway.

10. The connector structure of claim 9, wherein when the moving element moves along the second direction with respect to the first housing, the second slide moves in the horizontal section such that the moving element moves along the second direction with respect to the linking element, and the second slide is to be moved by the slated section such that the linking element moves along the first direction with respect to the first housing.

11. The connector structure of claim 1, wherein the first direction and the second direction are perpendicular to each other.

12. The connector structure of claim 1, wherein the first limiting parts are axle holes and the second limiting parts are limiting posts moving in the axle holes along the first direction.

13. The connector structure of claim 1, wherein the linking element further comprises a supporting part and a blocking part, the moving element comprises a slot corresponding to the position of the supporting part, the connector comprises a relieve bar, and the supporting part extends along the first direction through the slot and to abut against the connector; the blocking part is to abut against the relieve bar and restrain the connector from detaching off the connector structure when the connector is in connection with the connecting jack.

14. An electronic device, comprising:

a first housing comprising a plurality of first limiting parts extending along a first direction; and a connector structure for connecting a connector, the connector structure comprising:

a circuit board mounted on the first housing and comprising a connecting jack;

a moving element disposed between the circuit board and the first housing, the moving element comprising a pushing part and a first slide, the pushing part pushed by the connector so that the moving element is moved along a second direction with respect to the first housing and the circuit board; and a linking element disposed between the moving element and the first housing and moveable along the first direction, the linking element comprising a second slide and a plurality of second limiting parts, each of the plurality of second limiting parts corresponding and extending to each of the plurality of first limiting parts along the first direction, the second slide cooperating with the first slide;

wherein when the moving element moves along the second direction with respect to the first housing, the first slide is for moving the second slide such that the linking element is moved along the first direction with respect to the first housing and the circuit board and a connecting channel is formed to provide connection between the connector and the connecting jack.

15. The electronic device of claim 14, wherein the moving element further comprises a third slide and the first housing further comprising a fourth slide, each extending along the second direction, the third slide cooperating with the fourth slide such that the moving element is horizontally moveable with respect to the first housing.

16. The electronic device of claim 14, wherein the connector structure further comprises a restoring element disposed between the moving element and the first housing to be moved by the moving element to have a restoring force when the moving element moves along the second direction with respect to the first housing.

17. The electronic device of claim 14, further comprising a second housing assembled with the first housing, the second housing comprising an opening, the connector pushing the pushing part of the moving element through the opening.

18. The electronic device of claim 14, wherein the first slide of the moving element is a slideway comprising a horizontal section and a slanting section, the horizontal section extending along the second direction, the slanting section connected to the horizontal section and extending along a third direction, the second slide is a sliding block slidable in the slideway.

19. The electronic device of claim 18, wherein when the moving element moves along the second direction with respect to the first housing, the second slide moves in the horizontal section such that the moving element moves along the second direction with respect to the linking element and the second slide is to be moved by the slated section such that the linking element moves along the first direction with respect to the first housing.

20. The electronic device of claim 14, wherein the linking element further comprises a supporting part and a blocking part, the moving element comprises a slot corresponding to the position of the supporting part, the connector comprises a relieve bar, and the supporting part extends along the first direction through the slot and to abut against the connector; the blocking part is to abut against the relieve bar and restrain the connector from detaching off the connector structure when the connector is in connection with the connecting jack.

* * * * *